US006116134A

United States Patent [19]

Fransson et al.

[11] Patent Number: 6,116,134

[45] Date of Patent: Sep. 12, 2000

[54] CUTTER ARRANGEMENT

[75] Inventors: Jan-Olof Fransson; Jan Nilsson, both of Kalmar, Sweden

[73] Assignee: Norden Pac Development AB, Sweden

[21] Appl. No.: 09/117,766

[22] PCT Filed: Feb. 20, 1997

[86] PCT No.: PCT/SE97/00280

§ 371 Date: Aug. 5, 1998

§ 102(e) Date: Aug. 5, 1998

[87] PCT Pub. No.: WO97/31761

PCT Pub. Date: Sep. 4, 1997

[30] Foreign Application Priority Data

Mar. 1, 1996 [SE] Sweden ..... 9600806

[51] Int. Cl.[7] ..... B26D 7/26

[52] U.S. Cl. ..... 83/698.31; 83/599; 83/699.11

[58] Field of Search ..... 83/698.71, 698.91, 83/699.11, 598, 599, 698.31; 30/50, 49, 48, 67

[56] References Cited

U.S. PATENT DOCUMENTS

| | | | |
|---|---|---|---|
| 1,065,882 | 6/1913 | Lockwood | 83/598 |
| 2,107,581 | 2/1938 | Parsons et al. | 83/698.31 |
| 3,063,321 | 11/1962 | Nicolay | 83/598 |
| 3,499,370 | 3/1970 | Kulwicki et al. . | |
| 3,527,123 | 9/1970 | Dovey | 83/698.31 |
| 4,412,467 | 11/1983 | DeSanto . | |
| 4,531,439 | 7/1985 | Valente | 83/599 |
| 4,848,202 | 7/1989 | Crampton | 83/698.31 |
| 4,872,384 | 10/1989 | Borzym | 83/698.71 |

FOREIGN PATENT DOCUMENTS

| | | |
|---|---|---|
| 0 318 174 | 5/1989 | European Pat. Off. . |
| 2 248 577 | 10/1990 | United Kingdom . |

*Primary Examiner*—M. Rachuba
*Assistant Examiner*—Kim Ngoc Tran
*Attorney, Agent, or Firm*—Lerner, David, Littenberg, Krumholz & Mentlik, LLP

[57] ABSTRACT

Cutters are disclosed including a pair of cutting blade holders and a pair of cutting blades mounted for movement in a cutting direction with respect to each other, at least one of the blade holders comprising a sprung holder. The apparatus includes a pair of material-weakening channel zones associated with one of the cutting blades defining a supporting zone for that cutting blade, each of the pair of material-weakening channel zones including first and second material-weakening channels extending from the upper surface of the sprung holder and across the entire width of the sprung holder, and the second material-weakening channel juxtaposed with the first material weakening channel and extending from the lower surface of the sprung holder and across the entire width of the sprung holder, thereby creating material bridges between the two material-weakening channels creating an elongation zone, and an adjustment screw positioned in one of the material-weakening channels whereby the material bridges may be displaced in order to displace the supporting zone in an adjustment zone perpendicular to the cutting direction.

3 Claims, 2 Drawing Sheets

CUTTER ARRANGEMENT

FIELD OF THE INVENTION

The present invention relates to a cutter, in particular for trimming sealed packaging-tube ends.

BACKGROUND OF THE INVENTION

Cutting tools for the trimming of sealed packaging-tube ends are used in tube filling machines where the tubes are processed in an in-line procedure; i.e., empty tubes provided with a closure are set into a holder in the machine, the tubes are indexed to a filling station where the tubes are filled with product through their open ends and then closed in order to be finally fed out in the form of filled tubes.

Apart from these process steps, there are normally additional steps in the form of checking operations, marking stations and trimming (i.e., clean-cutting) of the seal which provides the closed end after filling.

Present machines operate at a high production speed, which requires precision in the various processing stations.

It has been shown that certain tube materials, typically those in laminate form, comprise layers which cause a great deal of wear on the cutting tools or the cutting edges. This wear is possibly due to the presence of silicon oxide in the material.

An object of the present invention is to allow self-adjustment of the cutting tool while at the same time maintaining precision, as well as allowing readjustment as soon as the self-adjustment is no longer sufficient.

In British Patent No. 2,248,577 there is disclosed a cutter which is designed particularly for cutting paper in fax machines. Primarily, the cutter provides adjustment means for positioning an active blade and a passive blade such that the effective distance between the cutting edges of the blades is not too long. By using a resilient support for the passive blade, the cutter blades initially are set to overlap.

SUMMARY OF THE INVENTION

In accordance with the present invention, these and other objects have now been realized by the invention of a cutter comprising a first blade holder for a first cutting blade, a second blade holder for a second cutting blade, support means for supporting the first and second blade holders juxtaposed with each other, a maneuvering mechanism for moving the first and second blade holders parallel to each other in a cutting direction between forward cutting positions wherein the first and second cutting blades meet in parallel movement in order to effect the cutting and return positions wherein the first and second cutting blades are separated from each other, at least one of the first and second blade holders comprising a sprung holder including an upper surface, a lower surface, a predetermined width parallel to the cutting direction, a pair of material weakening channel zones associated with one of the first and second cutting blades defining a supporting zone for the one of the first and second cutting blades, each of the pair of material weakening channel zones including a first material weakening channel extending from the upper surface of the sprung holder and across the entire predetermined width of the sprung holder, the second material weakening channel juxtaposed with the first material weakening channel, the second material weakening channel extending from the lower surface of the sprung holder and across the entire predetermined with of the sprung holder, thereby creating material bridges between the first and second material weakening channels creating an elongation zone, and an adjustment screw positioned in at least one of the material weakening channels whereby the material bridges may be displaced in order to displace the supporting zone in an adjustment direction substantially perpendicular to the cutting direction.

In accordance with a preferred embodiment of the present invention, the adjustment screw is conical and positioned in at least one of the first and second material weakening channels parallel to the cutting direction. In another embodiment, the first and second material weakening channels are provided by spark machining of the spring holder.

BRIEF DESCRIPTION OF THE DRAWINGS

The present invention may be more fully appreciated with reference to the following detailed description, which, in turn, refers to the drawings, in which.

DETAILED DESCRIPTION

Figure 1:
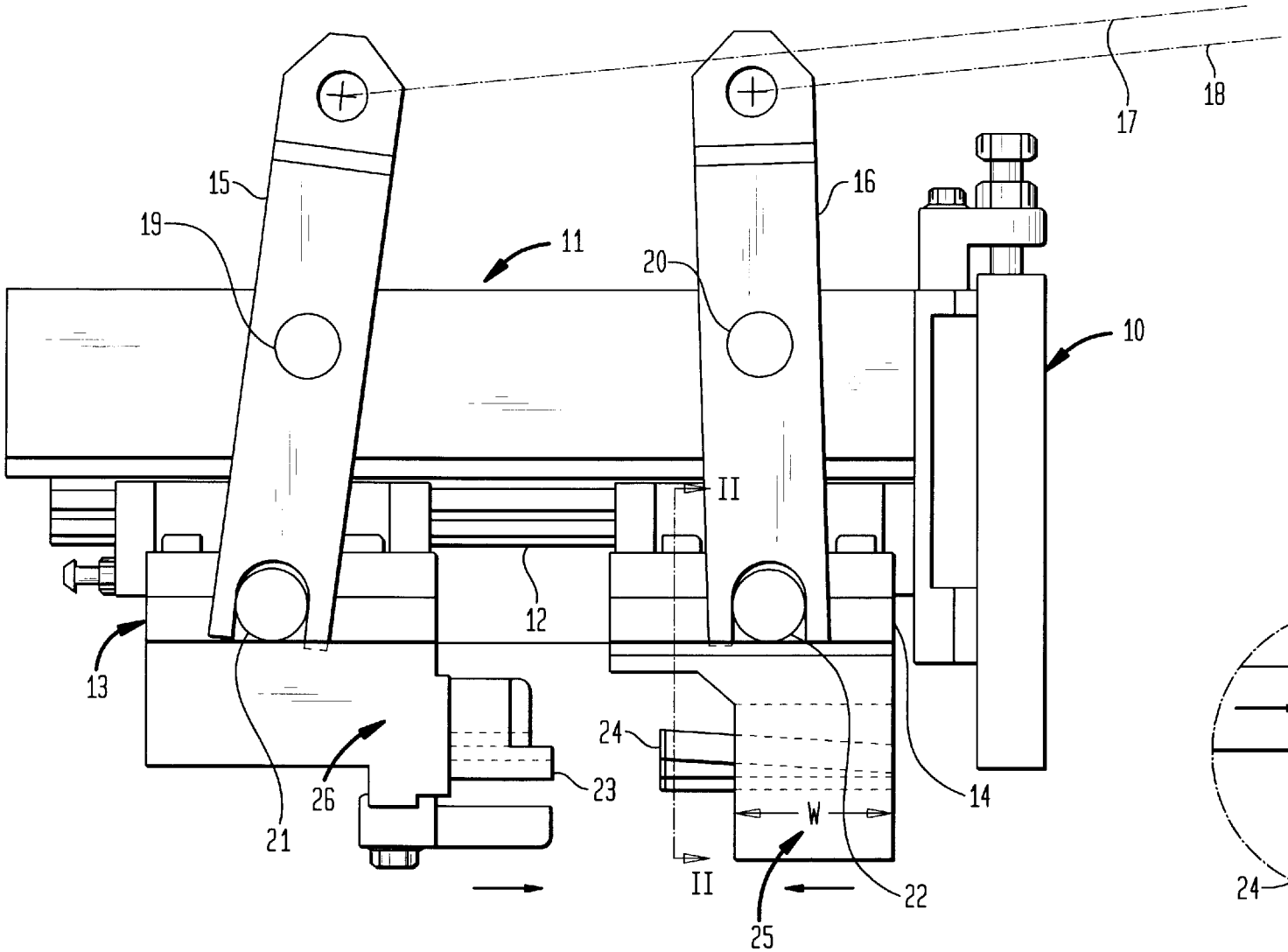
FIG. 1 is a side, elevational, schematic view of a cutter arrangement according to the present invention intended to be mounted in a tube filling machine.

Referring to the Figures, in which like reference numerals refer to like elements thereof, in FIG. 1, reference numeral 10 denotes a support part intended to be mounted on the tube filling machine at the trimming station thereof. A linear control 11 is arranged in conjunction with support part 10, and moving supports 13 and 14 are mounted on the linear control 11 by means of linkage arms, 15 and 16. The linkage arms are maneuvered by additional links, 17 and 18, for rotation around shafts, 19 and 20, and at the ends of the link arms, 15 and 16, these engage with dogs, 21 and 22, on the moving supports, 13 and 14. The moving supports are carried on a track 12.

On moving support 13, there is a holder 26 for a counter-blade 23 which, in the present embodiment, is removably supported but not sprung in the holder 26.

Figure 4:
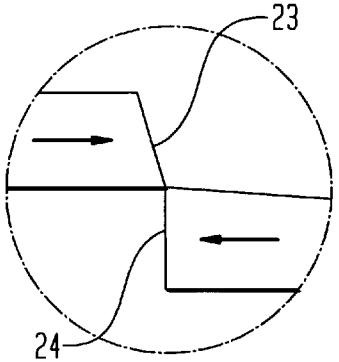
FIG. 4 is a partial enlarged representation of the parallel movement of the opposed cutting edges of the cutter blades of FIG. 2 in a forward cutting position wherein the cutting blades meet in parallel movement in order to effect cutting according to the present invention.

A cutting blade 24 is supported in the holder 25 and, as can be seen in FIG. 4, the counter-blade and the cutting blade, 23 and 24, perform a parallel movement with opposing cutting edges.

Figure 2:
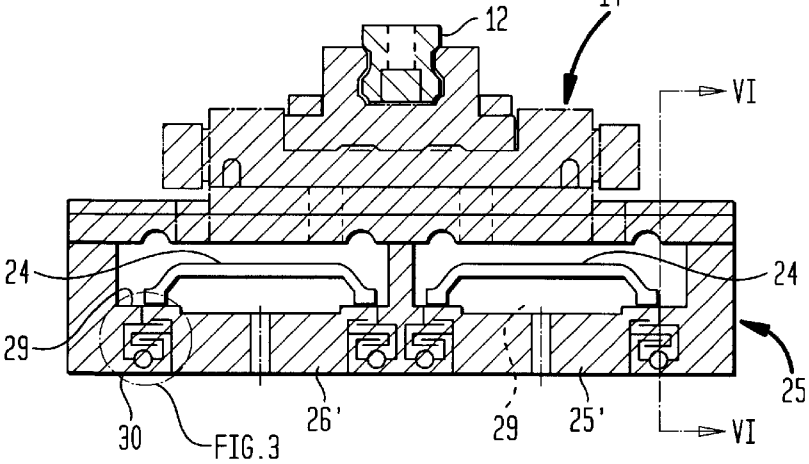
FIG. 2 is an elevational, schematic cross-sectional view of the sprung cutter arrangement taken along line II—II of FIG. 1 according to the present invention.
Figure 5:
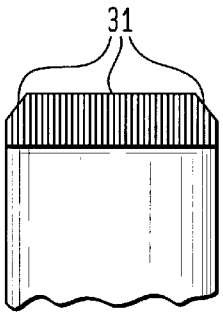
FIG. 5 is a partial enlarged side view of a packaging tube end trimmed with the cutter arrangement according to the present invention.

FIG. 2 shows schematically in cross-section how a pair of cutting blades 24 are supported by a holder plate 25 of the moving support 14. The cutter arrangement in FIG. 2 is intended to achieve a trimming (clean cut) of two tube ends 31 (FIG. 5) in the trimming station, the tube ends 31 having been fed forward with the aid of indexable pairs of tube holders of the tube filling machine.

The cutter holder plate 25 comprises, as seen in accordance with FIG. 2, three vertically-extending webs, one of which is centrally placed and the remaining two of which are at respective ends of the plate. The pair of cutting blades 24 is fixed to the plate 25 by means of bolts applied through holes extending in a central plane through respective cutting blades 24.

The horizontal part of the holder plate 25 shown in FIG. 2 presents four sets of material-weakening channels, 27, 27', placed at the outer ends of the cutting blades in the lateral direction in FIG. 2, so that the cutting blades lie completely within respective pairs of channels which are open on the cutting blade side of the holder plate.

In this manner, a pair of sub-zones, 25' and 26', are formed, each of which carries one cutting blade 24.

Figure 3:
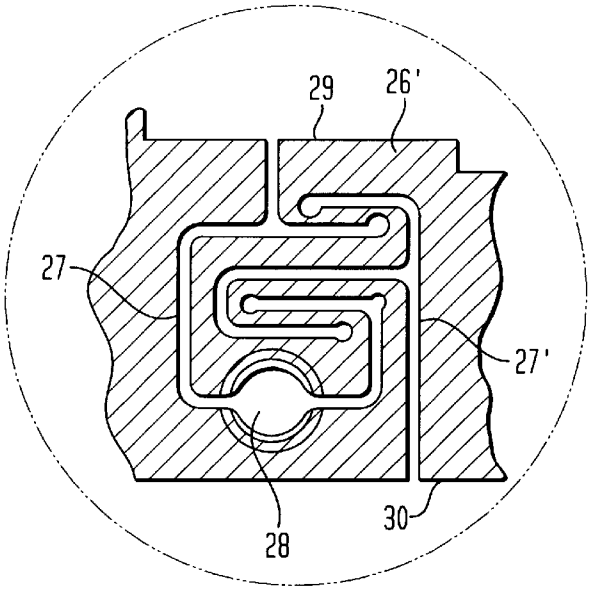
FIG. 3 is a partial enlarged cross-sectional view of the encircled area shown in FIG. 2.
Figure 6:
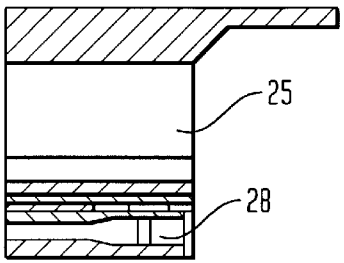
FIG. 6 is a side, elevational, sectional view of the cutter holder plate taken along line VI—VI in FIG. 2.

FIG. 3 more clearly shows how the channels, 27 and 27', are arranged. The channel 27 is open at the upper side 29 of holder plate 25 and extends over the whole width W (FIG. 1) of the holder plate as seen in a plane parallel to the plane of parallel movement of the cutter blades.

The other channel 27' is open at the lower surface 30 of the holder plate, and also has the same dimension as seen in a plane parallel to the plane of parallel movement.

The channels, 27 and 27', shown in FIG. 3, have horizontally and vertically extending parts, these being positioned so that narrow material bridges are formed between the channels, 27 and 27', and between the upper surface 29 and the lower surface 30 of the holder plate, so as to form elongation zones ("stretching" zones).

In one of the channels, channel 27 in this embodiment, there is an eccentric screw 28 for readjustment of the position of the cutting blade holder plate's cutting blade supporting surface 29.

Preliminary adjustment of the opposed counter blades 23 and cutting blade 24 (see FIG. 4) is made so that a spring effect from the material bridges between the channels, 27 and 27', will occur; i.e., a certain upwardly-directed force is exerted from the sprung, material weakened parts provided with channels in the part of the movement when the cutting blades or cutting edges meet in accordance with FIG. 4. By applying this force, the blades will come into contact with each other correctly even after a certain amount of wear.

When, however, the wear has reached such proportions that the available upwardly-directed extent of movement of the parts, 25' and 26', of the holder plate is no longer sufficient, a readjustment is necessary.

Such adjustment is performed with the adjustment screws 28 which, in the shown embodiment, are conical and provide lift to the surface 29 to a new self-adjusting level with certain limits.

The channels, 27 and 27', are suitably constructed with the aid of spark-machining and can thereby be given complicated dimensions in order to provide the best possible elongation characteristics and self-adjustment characteristics, respectively.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A cutter comprising a first blade holder for a first cutting blade, a second blade holder for a second cutting blade, support means for supporting said first and second blade holders juxtaposed with each other, a linkage mechanism for moving said first and second blade holders parallel to each other in a cutting direction between forward cutting positions wherein said first and second cutting blades meet in parallel movement in order to effect said cutting and return positions wherein said first and second cutting blades are separated from each other, at least one of said first and second blade holders comprising a sprung holder including an upper surface, a lower surface, a predetermined width parallel to said cutting direction, a pair of material weakening channel zones associated with one of said fist and second cutting blades defining a supporting zone for said one of said first and second cutting blades, each of said pair of material weakening channel zones including a first material weakening channel extending firm said upper surface of said sprung holder and across said entire predetermined width of said sprung holder, and a second material weakening channel juxtaposed with said first material weakening channel, said second material weakening channel extending from said lower surface of said sprung holder and across said entire predetermined width of said sprung holder, thereby creating material bridges between said first and second material weakening channels creating an elongation zone, and an adjustment screw positioned in at least one of said material weakening chapels whereby said material bridges may be displaced in order to displace said supporting zone in an adjustment direction substantially perpendicular to said cutting direction.

2. The cutter of claim 1 wherein said adjustment: screw is conical and is positioned in at least one of said first and second material weakening channels parallel to said cutting direction.

3. The cutter of claim 1 wherein said first and second material weakening channels are provided by spark machining of said sprung holder.

* * * * *

UNITED STATES PATENT AND TRADEMARK OFFICE

CERTIFICATE OF CORRECTION

PATENT NO. : 6,116,134

DATED : September 12, 2000

INVENTOR(S) : Fransson et al.

It is certified that error appears in the above-identified patent and that said Letters Patent is hereby corrected as shown below:

Column 3, line 15, "side" should read -- surface --.
Column 4, line 31, "firm" should read -- from --.
Column 4, line 41, "chapels" should read -- channels --.
Column 4, line 45, cancel the colon ":" .

Signed and Sealed this

Twenty-second Day of May, 2001

*Attest:*

Nicholas P. Godici

NICHOLAS P. GODICI

*Attesting Officer*

*Acting Director of the United States Patent and Trademark Office*